United States Patent [19]

Voellm

[11] Patent Number: 4,885,823

[45] Date of Patent: Dec. 12, 1989

[54] METHOD AND APPARATUS FOR ORIENTING FIBRES

[75] Inventor: Ernst B. Voellm, Horgen, Switzerland

[73] Assignee: Siegfried Payer, AG, Wollerau, Switzerland

[21] Appl. No.: 192,234

[22] Filed: May 9, 1988

[30] Foreign Application Priority Data

May 12, 1987 [CH] Switzerland ..... 1825/87

[51] Int. Cl.[4] ..... D01G 25/00

[52] U.S. Cl. ..... 19/296

[58] Field of Search ..... 19/0.56, 144, 161.1, 19/296

[56] References Cited

U.S. PATENT DOCUMENTS 2,709,834 4/1955 Wilkie ..... 19/0.56
2,795,010 6/1957 Hess ..... 19/0.56
2,889,583 6/1959 Wacker et al. ..... 19/161.1

FOREIGN PATENT DOCUMENTS 802451 10/1958 United Kingdom ..... 19/144

*Primary Examiner*—Werner H. Schroeder
*Assistant Examiner*—D. Price
*Attorney, Agent, or Firm*—Helfgott & Karas

[57] ABSTRACT

For the formation of fleeces or webs with parallelized, hooklet-free fibres for pattern production or for spinning mills, a raw material undergoes preliminary drawing in a preliminary drawing frame and is then supplied to a feed arrangement, through which the raw material is supplied to a clamping point of an extracting device formed of two clamping rollers. The clamping rollers running at a higher speed than the feed speed of the feed arrangement pull out fibre tufts disentangled and parallelized on one side. Then the tufts are fed to a suction drum for doubling purposes. From the suction drum the web formed with one disentangled side is fed into a further preliminary drawing frame, into a second feed arrangement, then into a further extracting device and thereafter into a further suction drum. As a result of this second extraction treatment the tangled fibres still present are drawn out, disentangled and parallelized, and a continual web suitable for further processing is removed from the second suction drum.

29 Claims, 2 Drawing Sheets

METHOD AND APPARATUS FOR ORIENTING FIBRES

BACKGROUND OF THE INVENTION

The present invention relates to a method for orienting fibres, which are present in a disordered arrangement in a textile raw material and for forming a fleece or web with parallelized, hooklet-free fibres, the raw material spread out in strip-like manner being given an advance movement.

The field of use of the invention is in the treatment of textile raw materials from which are formed webs with parallelized, hooklet-free fibres. These web can be further used for various purposes, particular reference being made to two applications. Firstly from said webs samples are taken and used for fibre length measurement purposes. The fibres of these samples are arranged end on in an apparatus and transferred to a measuring substrate on which in a further apparatus the fibre length is measured and the staple diagram, i.e. the representation of all the fibres, arranged in accordance with their length, is automatically determined. In connection with the measurement of the fibre length reference is made to the two publications of the Applicant "Measurement of the fibre length for short staple fibres Al 100/101; specification for pattern preparation and short instructions for pattern preparation in conjunction with a fibre blending machine". It can be gathered from these publications that webs for pattern preparation for measuring the fibre length largely have to be manually prepared. Therefore the measurement of the fibre length is to a considerable extent dependent on the skill of the person performing this work.

With larger machines, it is possible to produce webs in the spinning mill, so that it is possible to economize on operations required in the conventional preparation. In particular there is no need for machines for flock feeding, flock disentangling (card) and two drawing frame passages are not required.

SUMMARY OF THE INVENTION

It is an object of the present invention to so further develop a method of the aforementioned type that it is possible to completely mechanically produce webs with parallelized, hooklet-free fibres.

According to the invention this object is attained by a method in which the raw material with the fibres in a disordered or tangled arrangement undergoes a treatment during its advance, whereby the raw material is zonally contacted and from the same are extracted successive fibre tufts for parallelizing the fibres, a web being formed from the fibre tufts disentangled on one side in this way by doubling the fibre tufts.

Appropriately the web formed from the superimposed fibre tufts with the side having the disentangled, parallelized fibres first undergoes the same treatment for disentangling and parallelizing the tangled fibres still present on the other side of the fibre tufts and for doubling the latter.

The invention also covers an apparatus for orienting fibres present in a tangled arrangement in a textile raw material in order to give a web having parallelized, hooklet-free fibres, whose function is the optimum performance of the inventive method. According to the invention this problem is inventively solved in that an extracting device is provided for extracting the fibre tufts and with which a feed means is associated for supplying the raw material, the extracting device containing means for clamping the fibres during extraction and has a higher speed than that of the feed means.

BRIEF DESCRIPTION OF THE DRAWINGS

The inventive method is described in greater detail hereinafter relative to a diagrammatically represented embodiment of an inventive apparatus and the attached drawings, wherein.

DETAILED DESCRIPTION OF THE PREFERRED EMBODIMENTS

Figure 1:
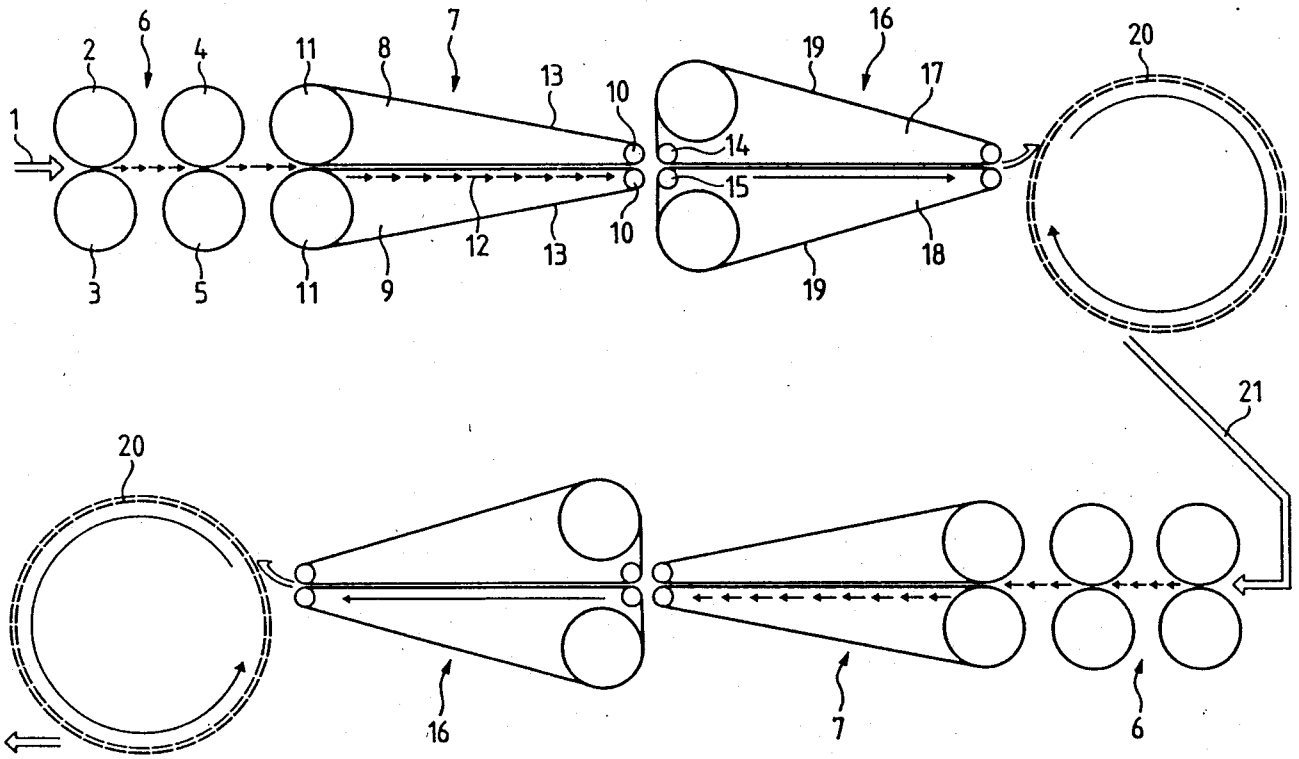
FIG. 1 is a diagrammatic representation of an apparatus for orienting fibres present in a tangled or disordered arrangement in a textile raw material.

In the case of the apparatus diagrammatically represented in FIG. 1 and which can e.g. be used for forming webs or fleeces for pattern production, cf. the publications referred to hereinbefore, 1 is the raw material, e.g. cotton flocks, wool fibres, etc., with which the apparatus is continuously or intermittently supplied. The raw material 1 is firstly fed into a preliminary drawing frame 6 formed from two rollers 2, 3 and 4, 5. A preliminary orientation of the fibres of the raw material 1 is brought about by a difference in speed of the two roller pairs in the preliminary drawing frame 6 by a relatively small deformation or draft, approximately 1, 2 or 3 times. The preliminary drawing frame 6 can be constructed in conventional manner with an adjustable spacing of the roller pairs 2, 3 and 4, 5. However, it is also possible to use a preliminary drawing frame 6 with a constant spacing of roller pairs 2, 3 and 4, 5 and the preliminary drawing can be made independent of the fibre length by an appropriate distribution of the forces on the roller pairs. In the preliminary drawing frame 6 the fibre material does not move in a continuous manner and is instead synchronized by a continuously variable driver with the movement of a feed means 7 positioned downstream of frame 6 and whose feed or advance takes place in small steps.

The feed means 7 comprises two belt or tape drives 8, 9, whose output-side roller 10 is much smaller than the input-side roller 11. The advance of the belt drives 9 taking place in small steps is symbolized by a number of small arrow 12. The feed means are used as part of a draft system formed by roller pairs 4, 5 and 11.

A further deformation is applied (by the speed difference of the roller pairs) to the raw material 1 between the preliminary drawing frame 6 and the feed means 7. The feed means 7 must at least be as long as the longest individual fibres to be processed with the apparatus. Between the belts 13 of belt drives 8, 9 the fibres are moved to the output side of the said drives 8, 9, where the raw material 1 is held between rollers 10. The holding power must be no greater than that necessary for ensuring damage-free extraction of the fibres.

The fibres now pass stepwise into the vicinity of two nip, pinch or clamping rollers 14, 15 of an extracting device 16 formed from two belt drives 17, 18. The belts 19 of extracting device 16 pass continuously in the opposite direction to the belts of feed means 7. The speed of belts 19 must be sufficient to ensure that the longest individual fibres to be processed with the apparatus can be completely conveyed away within a feed interval of feed means 7. The clamping rollers 14, 15 draw out a type of fibre tuft which, on the front side considered in the direction of movement, still has a number of disordered fibres, whereas on the back side of the fibres by the drawing movement are disentangled, parallelized and largely hooklet-free.

The extracting device 16 now brings the drawn out fibre tufts to a suction drum 20, whose circumferential speed corresponds as regards magnitude and direction to the extraction speed of the extracting device 16. Air is sucked into the interior of the drum through a porous surface of suction drum 20, so that the fibre tufts adhere to the outside of the drum. The constantly arriving new fibre tufts gradually cover the entire circumference of the drum, so that a compact and very uniform web is formed which, after a certain time following separation, can be detached from the outside of the drum in the opposite rotation direction. This web which can be called an intermediate web only has tangled fibres in one direction, only on the back side. The drum must stop rotating before the web is detached. The back side of the fibres is used as clamp side in order to parallelize the fibre ends which are not yet parallelized by a drawing action.

The intermediate web indicated by arrow 21 and detached from the suction drum 20 is now fed with the reverse side, i.e. with the disentangled fibres first into a further apparatus, which is constructed in the same way as the aforementioned apparatus from a preliminary drawing frame 6, a feed means 7, an extracting device 16 and a suction drum 20.

If no second apparatus is available, the intermediate web 21 with the reverse side first can again be fed into the same apparatus. In both cases this leads to a drawing out of the still tangled fibres, so that they are disentangled and parallelized. It is now possible to remove from the suction drum 20 a web suitable for further processing, e.g. for end-on arrangement in a fibre orienting apparatus according to Swiss Pat. No. 2029.86-4.

Figure 2:
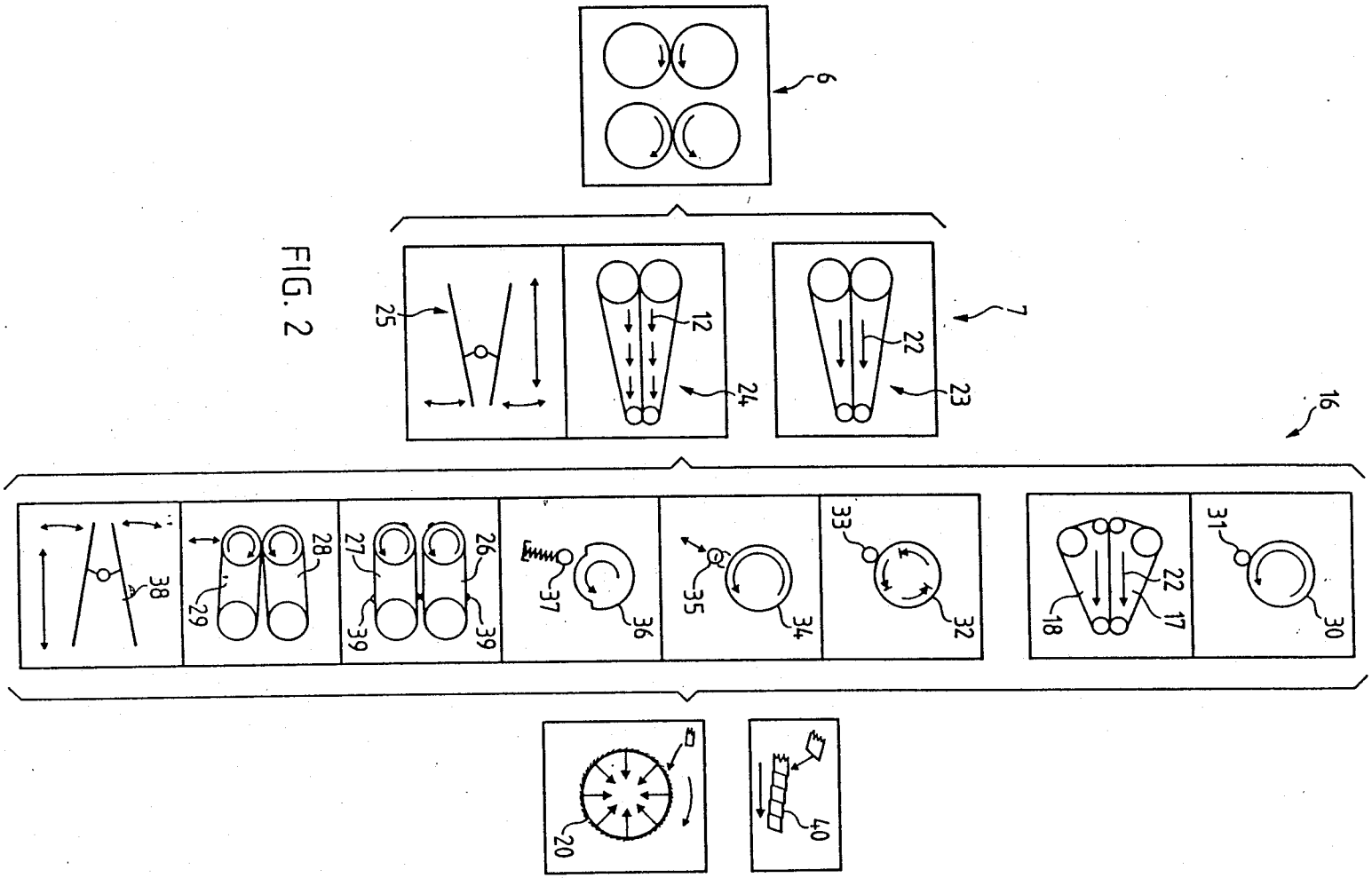
FIG. 2 is a pictorial, diagrammatic representation of variants of the apparatus according to FIG. 1.

The apparatus shown in FIG. 1 can be modified in different ways without modifying its function i.e. the purely mechanical formation of a web with parallelized, hooklet-free fibres. Thus, it is possible to continuously drive the feed means 7. Further modification are shown in FIG. 2, where the same references as in FIG. 1 are used. A row of short arrows 12 indicates a discontinuous feed, whilst the longer single arrows 22 indicate a continuous feed.

The preliminary drawing frame 6, which is essentially only used in one construction, is followed by the feed means 7, which can be constructed as a continuous feed means 23 or as a discontinuous feed means 24 or as a reciprocating gripping device 25. When the latter is used the raw material is fed continuously or discontinuously.

A large number of different constructions are possible for the extracting device 16. In particular, in place of the belt drive 17, 18 or belt drives 26, 27 or 28, 29 used in FIG. 1, it is possible to use roller pairs 30, 31; 32, 33; 34, 35 and 36, 37 or a gripping device 38. Roller pairs 30, 31 and belt drives 17, 18 run continuously, whereas the roller pair 32, 33 is discontinuously driven.

Roller pair 34, 35 runs continuously. However, as the smaller roller 35 is periodically raised from the larger roller 34, the raw material is discontinuously removed and this also applies with respect to roller pair 36, 37. The larger roller 36 has a smaller radius sector, within which there is no contact with the small roller 37. Operation is discontinuous with the belt drives 26, 27. An entrainment of the raw material only takes place when the clamping strips 39 located on the outside of the belts meet.

In the case of belt drives 28, 29 there is also a discontinuous conveying of the belt material, because on the input side one roller of the belt drive 29 is periodically moved away from the opposite roller.

In the case of gripping device 38 there is also a discontinuous feeding of the raw material. It is possible to combine with this a feed means 7 with continuous or discontinuous feed. Substantially all the variants shown in FIG. 2 can be combined with one another.

Following the pulling out or extraction of the fibre beards, they are doubled to form a web. For this purpose use is made of the suction drum 20 or a conveyor belt 40, the latter making it possible to produce randomly long webs. The described apparatus not only makes it possible to produce webs for measuring purposes. In the case of a corresponding increase in the dimensions of the feed means 6, extracting device 7 and conveyor belt 40 for doubling the extracted fibre tufts, whereby the disentangling and parallelizing of the fibres can be performed continuously in a second passage, it is possible to produce webs, e.g. for the spinning mill, in a simpler manner.

What is claimed is:

1. A method for processing fibres present in a disordered arrangement in a textile raw material comprising the steps of:

advancing strips of said textile raw material having fibres in a disordered and tangled arrangement;

zonally contacting and connecting said material during said advance to successively draw therefrom fibre tufts for parallelizing the fibres; and providing doubling means receiving said successively drawn fibre tufts and upon receiving newly arrived fibre tufts, placing the tufts in superimposed position and forming from the fibre tufts a compact continuous web having parallelized and disentangled fibre tufts on one side thereof.

2. A method according to claim 1, wherein prior to said advancing step, the raw material undergoes preliminary drawing.

3. A method according to claim 1, wherein a constant feed movement is imparted to the raw material.

4. A method according to claim 2, wherein a constant feed movement is imparted to the raw material.

5. A method according to claim 3, wherein following the contacting of the raw material, the fibre tufts are drawn out at a higher speed compared with the feed movement.

6. A method according to claim 4, wherein following the contacting of the raw material, the fibre tufts are drawn out at a higher speed compared with the feed movement.

7. A method according to claim 3, wherein following the contacting of the raw material, the fibre tufts are drawn out at a higher speed compared with the feed movement.

8. A method according to claim 1, wherein the web formed from the superimposed fibre tufts with the side having the disentangled, parallelized fibres is further supplied for the same processing for disentangling and parallelizing the tangled fibres still present on the other side of the fibre tufts and for doubling the latter to form a fleece.

9. A method according to claim 4, wherein the web formed from the superimposed fibre tufts with the side having the disentangled, parallelized fibres first is supplied for the same processing for disentangling and parallelizing the tangled fibres still present on the other side of the fibre tufts and for doubling the latter to form the fleece.

10. Apparatus for processing fibres present in a disordered arrangement in a textile material to form a web having parallelized, hook-free fibres comprising:

feed means for supplying a raw material at a selected speed;

extracting means coupled to said feed means for extracting successive fibre tufts from said raw material, said extracting means being provided with means for clamping the fibres on drawing out and having a higher speed than the speed of the feed means; and doubling means for receiving said successively extracted fibre tufts from said extracting means and, upon receiving newly arrived fibre tufts, placing said tufts in superimposed position and forming a compact continuous web having parallelized and disentangled fibre tufts on one side thereof.

11. An apparatus according to claim 10, wherein the means for clamping the fibres are constructed as a driven clamping roller pair, having clamping rollers forming a clamping point and adapted to at least temporarily engage and roll on one another.

12. An apparatus according to claim 11, wherein the means for clamping the fibres are constructed as two cooperative belt drives each having one belt, a driving roller and a deflecting roller, the belts of said drives being at least temporarily and in the vicinity of two cooperating rollers in a clamping contact.

13. An apparatus according to claim 12, wherein the belts of the belt drives are externally provided with clamping strips, which in the vicinity of the roller pair directed against the feed means form a clamping point.

14. An apparatus according to claim 12, wherein one roller of the roller pair directed against the feed means is reciprocatable with respect to the other roller and on contact with the latter forms the clamping point.

15. An apparatus according to claim 12, wherein the means for clamping the fibres are constructed as a clampable and detachable gripping device with means for reciprocating the same.

16. An apparatus according to claim 10, wherein the extracting means is immediately followed by said doubling means.

17. An apparatus according to claim 16, wherein the doubling means is constructed as a suction drum with a smaller feed speed than that of the extracting means.

18. An apparatus according to claim 10, wherein the feed means is formed from two synchronously driven belt drives.

19. An apparatus according to claim 10, wherein the feed means is a clampable and detachable gripping device with reciprocating means.

20. A method according to claim 1, and further comprising repeating said steps of advancing, connecting, providing doubling means and forming to produce parallelized and disentangled fibre tufts on an opposite side of said web.

21. A method according to claim 1, wherein intermittent feed movement is imparted to the raw material.

22. An apparatus according to claim 11, wherein said clamping roller pair is continuously driven.

23. An apparatus according to claim 11, wherein said clamping roller pair is discontinuously driven.

24. An apparatus according to claim 11, wherein said clamping rollers have the same diameter.

25. An apparatus according to claim 11, wherein said clamping rollers are of different diameters.

26. An apparatus according to claim 10, wherein said doubling means is constructed as an electrostatically chargeable drum.

27. An apparatus according to claim 10, wherein said doubling means is constructed as a conveyor belt.

28. An apparatus according to claim 18, wherein said belt drives are continuously driven.

29. An apparatus according to claim 18, wherein said belt drives are discontinuously driven.

* * * * *